United States Patent [19]

Fleissner

[11] Patent Number: 4,656,845

[45] Date of Patent: Apr. 14, 1987

[54] APPARATUS FOR APPLYING A LIQUID FILM OF LARGE WIDTH TO A LENGTH OF MATERIAL

[75] Inventor: Gerold Fleissner, Chur, Switzerland

[73] Assignee: Vepa Åktiengesellschaft, Riehen/Basel, Switzerland

[21] Appl. No.: 780,691

[22] Filed: Sep. 26, 1985

[30] Foreign Application Priority Data

Jun. 21, 1985 [DE] Fed. Rep. of Germany ..... 3522320

[51] Int. Cl.[4] ..... B05C 5/02

[52] U.S. Cl. ..... 68/205 R; 118/407; 118/DIG. 4

[58] Field of Search ..... 118/407, DIG. 4, 410, 118/411; 68/205 R, 200

[56] References Cited

U.S. PATENT DOCUMENTS

| | | | |
|---|---|---|---|
| 4,377,129 | 3/1983 | Glotzbach | 118/410 X |
| 4,427,722 | 1/1984 | Keller | 118/407 X |
| 4,500,039 | 2/1985 | Pacifici et al. | 118/DIG. 4 |

FOREIGN PATENT DOCUMENTS

| | | | |
|---|---|---|---|
| 2752982 | 5/1979 | Fed. Rep. of Germany | 118/DIG. 4 |

*Primary Examiner*—John P. McIntosh

*Attorney, Agent, or Firm*—Antonelli, Terry & Wands

[57] ABSTRACT

A liquid applicator for a wide length of material, operating according to the overflow principle, has a construction which ensures uniform dye application over the operating width. This applicator now makes it possible to effect quick color change, because the capacity of the applicator is smaller than 5 l/m and, by a special arrangement of liquid-distributing chambers in the applicator, a uniform liquid film exhibiting laminar flow is ensured.

23 Claims, 3 Drawing Figures

APPARATUS FOR APPLYING A LIQUID FILM OF LARGE WIDTH TO A LENGTH OF MATERIAL

This invention relates to an apparatus for applying a laminar-flow liquid film, which is uniformly thin over the operating width of a guide surface preferably a surface with a large width, to a continuously advanced length of textile or like material, which includes a liquid reservoir supplied from a pump, an overflow weir, and the guide surface following the overflow weir; the apparatus being arranged so that an overflowing liquid film runs onto the length of material from the lower edge of the guide surface.

An apparatus of this type is known from German Utility Model No. 7,403,152. The liquid reservoir arranged upstream of the overflow weir not only exhibits a large volume of about 200 l/m and more, but also houses several liquid-wetted, expensive baffle elements or liquid-smoothing members, necessary for the formation of a liquid film proceeding with laminar flow over the guide surface. Under practical conditions, application quantities of 30–100 l/min/m are customary. Consequently, a strong stream of liquid must flow continuously into the liquid reservoir. Since rather strong eddies are created at the inlet orifice of the reservoir, a liquid film flowing in laminar mode over the guide surface can only be obtained if, firstly, the reservoir for the liquid is sufficiently large and, secondly, smoothing elements, such as baffle walls, overflow members and the like, are arranged in the reservoir upstream of the actual overflow weir.

Liquid application devices operating according to the overflow principle have the advantage that it is possible thereby to attain an exact, uniform applied, quantity over the operating width. However, the large liquid reservoir is a disadvantage; this reservoir must first be cleaned before changing colors of a dye liquor, the operation thus losing the dye liquor contained in the liquid reservoir. In any event, the new dyestuff stream cannot flow immediately following the preceding dyestuff, because the dyes would be intermixed in the large volume of the liquid reservoir.

A more rapid change of dyes is made possible with the aid of the device according to DOS No. 3,127,469, according to which an applicator beam is associated with the length of material over the operating width, this beam being equipped with chambers open toward the length of material, each of the chambers being in communication, via a hose connection, with a liquid storage tank under pressure. Via the large number of hose connections, only a small volume of fluid medium is then fed into the respective chamber so that in this way a rapid change of dyestuffs is possible without production losses. There is the disadvantage, though, that formation of streaks in the dyed product cannot be avoided, resulting from a nonuniform distribution of the dyestuff liquor over the operating width of the device (and the length of material), and from the large number of hose connections.

Starting with an apparatus of the type heretofore described, i.e., an apparatus that operates according to the overflow principle, the invention is based on the object of providing an apparatus so that a rapid change of applied liquid is made possible without incurring the heretofore resulting loss in production of the length of textile material to be wetted, but so that simultaneously an exact, uniform distribution of the applied liquid over the operating width of the apparatus (as well as the width of the length of textile material) is ensured as well.

In order to attain the thus-posed objective, the invention provides that the capacity of the liquid reservoir, even with an application rate of more than 30 liter/minute/meter width, is smaller than 5 liter/meter, preferably smaller than 2.5 liter/meter of the operating width of the device. Therefore, the basic idea is, first of all, that the liquid reservoir is, in volume, considerably smaller than if it were designed according to the state of the art.

In order to achieve the smoothing of the liquid feed stream up to the overflow weir, necessary for the formation of a laminar-flow liquid film, one version of the apparatus provides that the liquid reservoir arranged upstream of the overflow weir flares or widens conically toward the overflow weir. In this connection, it is the state of the art to provide the liquid reservoir with a baffle adjoining the overflow weir, this baffle being oriented obliquely to the horizontal upwardly toward the overflow weir. For the formation of the conically widening liquid reservoir, the provision is made, therefore, to arrange a diffuser wall in opposition to this baffle, the diffuser wall being arranged with respect to the baffle to be steeper under an angle of about 10° in order to form the liquid reservoir that flares conically toward the overflow. The free end of the diffuser wall can be erected even more steeply at the height of the liquid level.

With an apparatus of this type wherein the liquid reservoir opens gradually conically, beginning with a liquid feed slot having a cross section of about 2 mm and extending over the operating width, any turbulence that may still be present in the liquid feed slot is smoothed in such a way that the required uniform liquid film is then present on the guide surface. In case of very thin liquids, such as water, for example, i.e., liquors without a thickener, it can be advantageous to arrange, within the liquid reservoir, a liquid-permeable curtain, such as a mesh fabric or the like, from the diffuser wall to the baffle, over the operating width. This curtain effects further smoothing of the film which flows off, immediately thereafter, over the overflow weir.

It is important, for smoothing the liquid current and for producing a uniformly thick liquid film in the zone of the overflow weir, that the quantity of liquid, supplied to the apparatus at a high velocity, slows down from the narrow liquid feed slot to the height of the level at the overflow weir. It has been found that the production of the desired uniform liquid film can be affected by many measures, in spite of a small volume in the liquid reservoir. Thus, it is advantageous, for example, for the liquid feed slot to extend over a relatively large length of, for example, 25 mm, with the cross section remaining the same. It is also possible to arrange displacement members in the liquid feed slot, for example, displacement members that are widened conically toward the overflow weir. Such displacement members, however, can also be located upstream or downstream of the liquid feed slot. In this connection, worth mentioning, for example, is a threaded rod or the like disposed in the zone of the liquid feed slot on the side of the reservoir.

Of special advantage for the uniform formation of the liquid film is a liquid distributing chamber arranged upstream of the liquid feed slot, this chamber being designed along the operating width to be of constant cross section and advantageously being smaller in cros section than the liquid reservoir. The fluid medium flows into this liquid distributing chamber via bores, of which only, for example, two are distributed over a meter of operating width, at a high feed rate. In this connection, it is suitable to effect distribution of the liquid over the operating width from the liquid distributing chamber to the liquid feed slot by means of an additional throttling point provided by a screen plate, the passage openings of which should be remote from the liquid feed slot.

The accompanying drawings illustrate one embodiment of the apparatus according to this invention. The invention will be described in detail below the reference to this embodiment, including further inventive features which are also of importance in combination. In the drawings.

Figure 1:
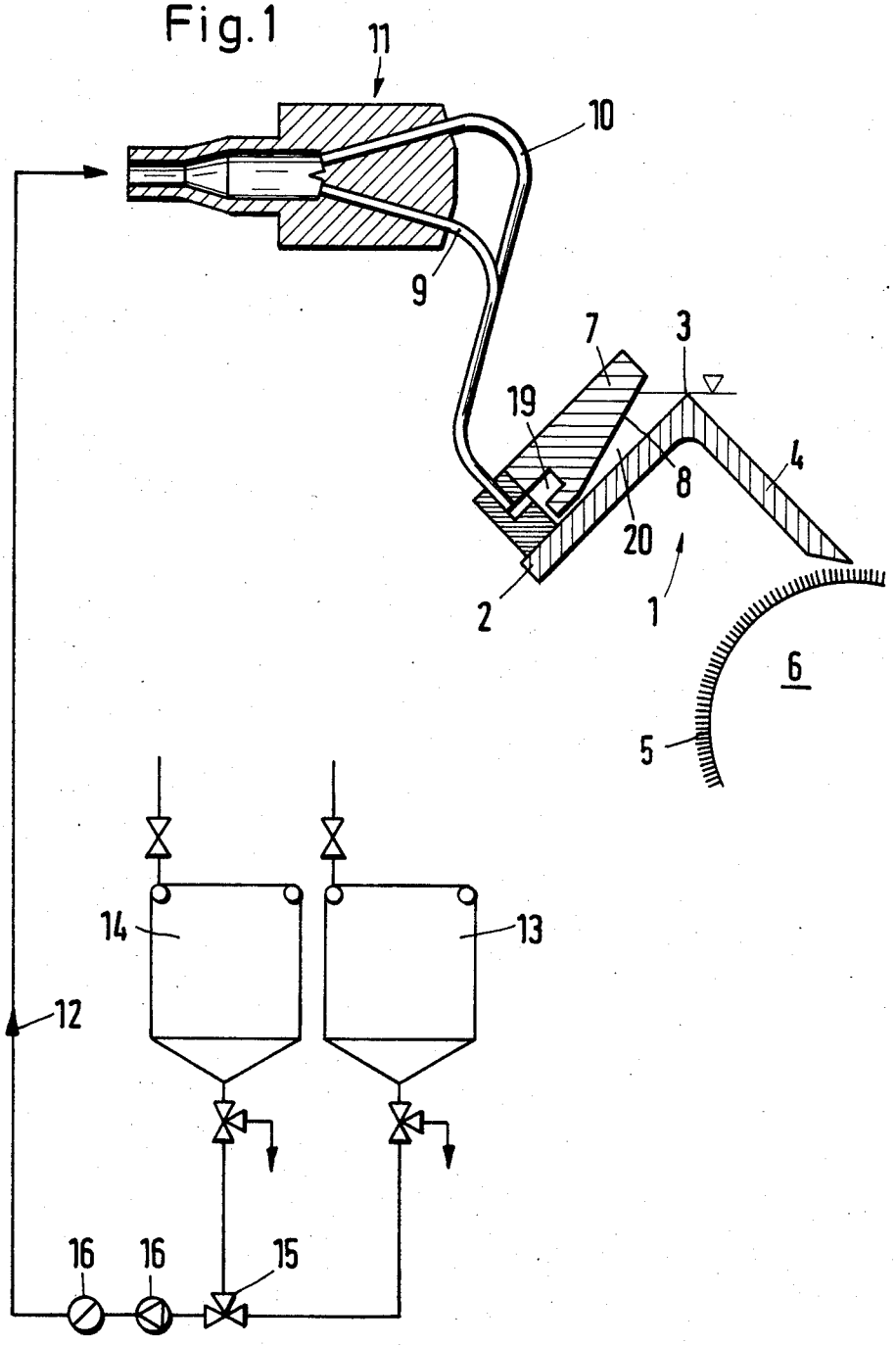
FIG. 1 shows the liquid applicator in a schematic partially sectional view with the distributing tanks arranged upstream thereof.

The liquid application device according to this invention consists, as shown in FIG. 1, of an angular support 1, the 90° corner of which is oriented in the upward direction. One leg of the angular support is formed by the baffle 2 oriented obliquely upwardly in the direction toward the overflow weir or edge 3. The overflow weir 3 is adjoined by the other leg having a guide surface 4 over which runs the uniformly disstributed liquid film and flows onto the length of textile material 5 guided along therebelow. The length of material 5 is carried, with upwardly pointing nap, over a guide roll 6. A solid body or element 7 is arranged on the side overlying oppositely to the baffle 2, the wall of this body operatively associated with the baffle 2 being designated as the diffuser wall 8. The body 7 extends over, for example, one meter of operating width and is equipped, over this operating width, with two supply hoses 9, 10 through which the required quantity of liquid flows to the liquid applicator means. For the uniform distribution of the supplied liquid, a branching means 11 is provided wherein the liquid fed in the direction of arrow 12 is divided uniformly into two partial streams. The liquid branching means 11 is preceded by two storage tanks 13, 14 that can be selectivelly connected thereto; these storage tanks are connected to the branching means 11 via a three-way valve 15 including flowmeters 16, etc.

Figure 2:
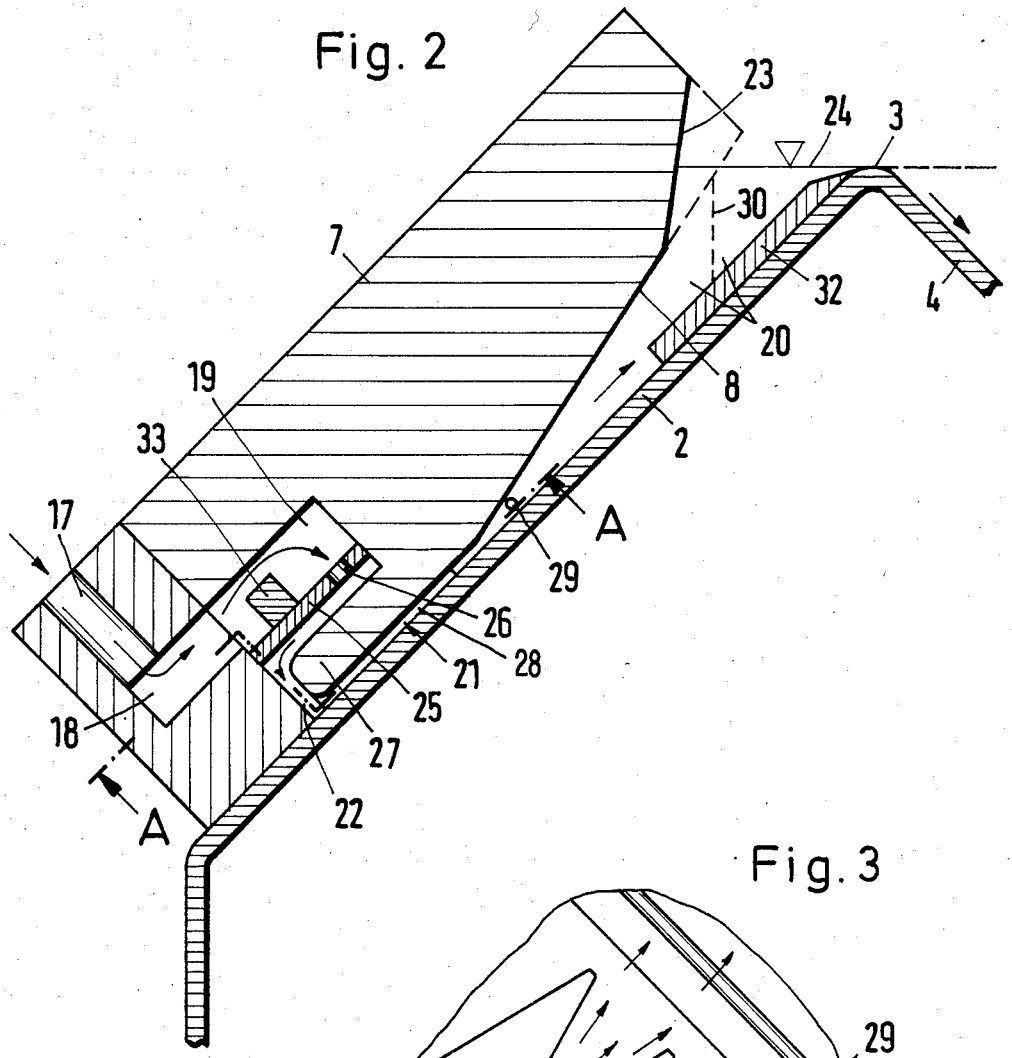
FIG. 2 shows a sectional view of the applicator on an enlarged scale.

The liquid applying portion of the liquid applicator device or means shown in FIG. 1 is illustrated in detail in FIG. 2. The liquid, divided into two partial streams by the branching means 11, flows, for example, via the hose 9 into the bore 17 at one section of the applicator means and from there into the semicircular orifice 18, the open side of which is directly associated with the liquid distributing chamber 19. At another section of the device the liquid enters via hose 10 into another bore 17. Thus, while over an operating width of 1 m, only two of the semicircular orifices 18 are provided, the liquid distributing chamber 19 extends uniformly over the entire operating width. From the liquid distributing chamber 19, a liquid feed slot 21, likewise extending over the operating width of the device, leads to the actual liquid reservoir 20; the feed slot 21 is in communication with the liquid distributing chamber 19 via a connecting slot 22 running perpendicularly to the feed slot 21. The liquid feed slot 21 extends over 20–25 mm, according to the illustration in Figure 2. However, it is generally sufficient for this slot 21 to merely precisely produce a constricted zone. It will be understood that the operating width of the device depends on the operating width of the length of material to be treated. If the width of the length of material is 1.60 m, then the operating width of the device is 1.60 m. If the device has an operating width greater than the width of the length of material to be treated with liquid, then both end zones of the device must be blocked off or covered to provide an operating width that corresponds to the width of the length of material.

The liquid reservoir 20 begins starting with the end of the liquid feed slot 21. This reservoir defines a storage chamber and is formed by two end walls (not shown) by the baffle 2 and by the diffuser wall 8, which wall is arranged to be steeper by about 10° with respect to the baffle 2 for the formation of the storage chamber as designated by reference numeral 20 which flares conically toward the overflow weir or edge 3. The end 23 of the diffuser wall 8 associated with the overflow weir 3 can be erected or arranged even more steeply where this end faces the liquid level 24.

It proved to be advantageous to arrange elements, effecting evening out of the throughflowing liquid at the overflow weir 3, in the liquid reservoir 20. In this connection, for example, the wall 32 is advantageous, which again abruptly constricts the conically flaring chamber 20. For further smoothing of the liquid in the storage chamber 20, the liquid can furthermore be steadied by a liquid-permeable curtain 30 extending from the diffuser wall 8 up to the baffle 2.

Besides the aforementioned measures for smoothing the liquid quantity entering with considerable turbulences in the zone of the liquid distributing chamber 19, it is furthermore to be mentioned that, for obtaining a liquid film running off completely smoothly over the overflow weir 3, a baffle 25 should be suitably arranged in the liquid distributing chamber 19; this baffle has a number of throughflow openings 26 along the operating width in the rear end of the liquid distributing chamber 19, limiting the flow cross section from the liquid distributing chamber 19 to these throughflow openings 26 to about 1/5 to 1/10. From there, the liquid flows back again to the connecting slot 22 and finally to the liquid feed slot 21, the liquid thus flowing around a lobe 27 extending toward the connecting slot 22.

A baffle strip 33 should be attached to the baffle 25 transversely in front of the bores 17, 18, so that the liquid entering from the small number of bores (two per meter) is distributed over the operating width upstream of the baffle strip 33, flows over the latter (see arrow) and only then passes on to the throughflow openings 26.

Figure 3:
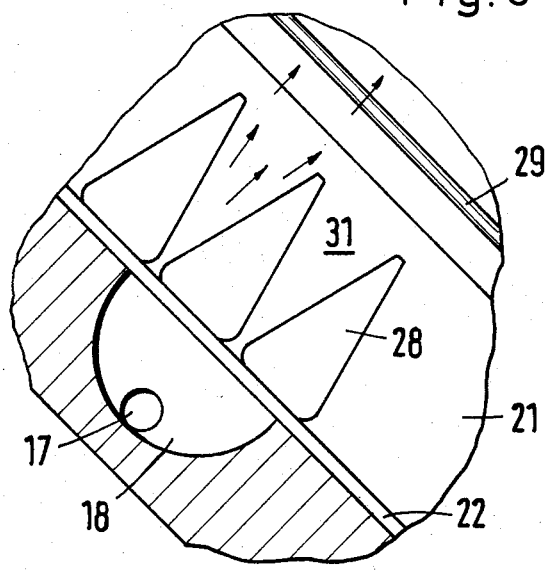
FIG. 3 is a cross-section through the apparatus of FIG. 2 taken along line A—A.

Displacement members 28 can be arranged in the liquid feed slot 21, as illustrated in FIG. 3. The illustrated displacement members 28 are of a triangular shape, are arranged in close juxtaposition, and thus leave a throughflow space 31 conically widening toward the overflow weir 3. A further smoothing of the liquid current is possible by disposing, for example, a threaded rod 29 in the accumulated chamber 20 in the zone of the end of the liquid feed slot 21.

Other, similarlly effective measures are possible and pertain to the subject matter of the invention.

What is claimed is:

1. An apparatus for applying a laminar-flow liquid film, preferably of a large width, which is uniformly thin over the operating width, onto a continuously advanced length of textile material comprises a liquid reservoir supplied by a pump, an overflow weir, and a guide surface following the overflow weir so that an overflowing liquid film runs off onto the length of material from the lower edge of the guide surface, said liquid reservoir having a holding capacity even in case of an applied liquid quantity of more than 30 l/min/m, that is smaller than 5 l/m of the operating width of the device; said liquid reservoir, being arranged upstream of the overflow weir, defining a storage chamber that opens up in a widening and flaring fashion toward the overflow weir, said reservoir comprising a baffle that adjoins the overflow weir and that is oriented upwardly, inclined with respect to the horizontal towards the overflow weir and a diffuser wall associated with the inclined baffle and arranged to face the baffle, said diffuser wall being more steeply arranged as compared with the baffle for the formation of the storage chamber that widens towards the overflow weir.

2. An apparatus according to claim 1, wherein an end of the diffusion wall associated with the overflow weir is even more steeply oriented in front of the liquid level within said chamber.

3. An apparatus according to claim 1, wherein a device constricting the cross section of the chamber is arranged in the liquid reservoir.

4. An apparatus according to claim 3, wherein a wall is arranged at the baffle parallel to and in the zone of the overflow weir.

5. An apparatus according to claim 3, wherein a liquid-permeable curtain extends over the operating width transversely through the liquid reservoir from the diffusion wall to the baffle.

6. An apparatus according to claim 1, wherein the diffuser wall forms, together with the baffle at the end in opposition to the overflow weir, a liquid feed slot extending over the operating width and being narrow in cross section.

7. An apparatus according to claim 6, wherein the liquid feed slot measures, in cross section, less than 5 mm.

8. An apparatus according to claim 6 or 7, wherein the liquid feed slot extends over a length relatively large as compared with its small cross section, this length being 20–35 mm.

9. An apparatus according to one of claims 6 and 7, wherein one or several displacement members, partially blocking the throughflow cross section, extend within or in the zone of the liquid feed slot.

10. An apparatus according to claim 9, wherein the throughflow cross section left by the displacement members flares outwardly toward the overflow weir.

11. An apparatus according to claim 10, wherein the displacement members are of a triangular configuration and are arranged in close juxtaposition.

12. An apparatus according to claim 9, wherein the displacement member is a threaded rod extending across the liquid feed slot.

13. An apparatus according to claim 6, wherein a liquid distributing chamber is arranged upstream of the liquid feed slot along the operating width, this distributing chamber being of constant cross section along the operating width.

14. An apparatus according to claim 13, wherein the liquid distributing chamber is designed to be smaller in cross section than the liquid reservoir.

15. An apparatus according to claim 13 or 14, wherein a connecting slot oriented perpendicularly to the liquid feed slot extends from the liquid distributing chamber to the liquid feed slot.

16. An apparatus according to claim 15, wherein the liquid distributing chamber is separated from the liquid feed slot by a lobe extending toward the connecting slot.

17. An apparatus according to claim 13, wherein the liquid distributing chamber is separated from a connecting slot by a barrier provided with throughflow openings.

18. An apparatus according to claim 17, wherein the throughflow openings are arranged at the opposite end of the liquid distributing chamber with respect to the connecting slot.

19. An apparatus according to claim 13, wherein the liquid distributing chamber is connected via bores distributed along the operating width of the reservoir with a liquid supply tank.

20. An apparatus according to claim 17, wherein a baffle strip extends from the barrier perpendicularly into the liquid distributing chamber and at a spacing in front of bores distributed along the operating width of the reservoir, the supplied liquid flowing over this baffle strip to the throughflow openings.

21. An apparatus according to claim 19, wherein the bores open, toward the liquid distributing chamber, into shells having an approximately semicircular shape.

22. An apparatus according to claim 19, wherein the bores are connected to the liquid supply tank by way of a distributor by means of hoses having the same diameter.

23. An apparatus according to claim 19 or 22, wherein only two bores and two hoses are uniformly distributed over the length of one meter of operating width of the reservoir.

* * * * *